US007777674B1

(12) United States Patent
Haddadin et al.

(10) Patent No.: US 7,777,674 B1
(45) Date of Patent: Aug. 17, 2010

(54) MOBILE DISTRIBUTED ANTENNA ARRAY FOR WIRELESS COMMUNICATION

(75) Inventors: Osama S. Haddadin, Salt Lake City, UT (US); Aurora Taylor-Rojas, Salt Lake City, UT (US); Timothy D. Jones, Cottonwood Heights, UT (US)

(73) Assignee: L-3 Communications, Corp., New York, NY (US)

( * ) Notice: Subject to any disclaimer, the term of this patent is extended or adjusted under 35 U.S.C. 154(b) by 62 days.

(21) Appl. No.: 12/195,043

(22) Filed: Aug. 20, 2008

(51) Int. Cl.
*H01Q 3/00* (2006.01)

(52) U.S. Cl. ..... 342/368; 342/372

(58) Field of Classification Search ..... 342/81, 342/154, 157, 368, 372, 373; 455/456.1, 455/456.6

See application file for complete search history.

(56) References Cited

U.S. PATENT DOCUMENTS

| | | | | |
|---|---|---|---|---|
| 5,365,516 | A * | 11/1994 | Jandrell | 370/335 |
| 2006/0094449 | A1* | 5/2006 | Goldberg | 455/456.6 |
| 2006/0223519 | A1* | 10/2006 | Yahagi | 455/421 |
| 2006/0232382 | A1* | 10/2006 | Bauer et al. | 340/10.1 |
| 2007/0076649 | A1 | 4/2007 | Lin et al. | |
| 2007/0086512 | A1 | 4/2007 | Can et al. | |
| 2007/0165581 | A1 | 7/2007 | Mehta et al. | |

OTHER PUBLICATIONS

Shau-Shiun Jan, et. al, Using GPS to Synthesize A Large Antenna Aperture When The Elements Are Mobile, Presented at ION NTM 2000, Anaheim CA, Jan. 26-28, 2000.

Ahmend K. Sadek, et. al, Clustered Cooperative Communications in Wireless Networks, 2005, pp. 1157-1161, IEEE Globecom.

Hideki Ochiai et. al, Collaborative Beamforming for Distributed Wireless Ad Hoc Sensor Networks, Draft, pp. 1-26, May 2005.

Aria Nosratinia et. al, Cooperative Communication in Wireless Networks, Article, pp. 74-80, IEEE Communications Magazine, Oct. 2004.

Lun Dong et. al, Cooperative Beamforming for Wireless Ad Hoc Networks, Article, pp. 1-5, Drexel University, Aug. 2007.

Sharon M. Betz, et. al, Cooperative Beamforming and Power Control, Article, Proceedings ACSSC 2007, pp. 2117-2123.

* cited by examiner

*Primary Examiner*—Dao L Phan
(74) *Attorney, Agent, or Firm*—Kirton & McConkie; William T. Ralston

(57) ABSTRACT

A mobile distributed antenna array can include a plurality of mobile platforms, each platform having at least one antenna element and radio equipment coupled to the at least one antenna element. The radio equipment can be capable of transmission, reception, or both of propagated radio signals. A control platform can be capable of communication with the mobile platforms to control movement of the mobile platforms to position the mobile platforms relative to each other to provide a desired array pattern.

39 Claims, 7 Drawing Sheets

MOBILE DISTRIBUTED ANTENNA ARRAY FOR WIRELESS COMMUNICATION

FIELD OF THE INVENTION

The present application relates to wireless communications. More particularly, the present application relates to antenna systems comprising a plurality of antenna elements.

BACKGROUND

Multi-element antenna arrays can provide performance advantages over single element antenna arrays. For example, radiation from multiple elements can be phased so that energy constructively adds in desired directions and destructively cancels in undesired directions. Multiple elements can also allow for gain increases. When adjustable phase shifts and gains are provided to the individual elements, adaptation of the antenna array can be performed in real time, enabling additional performance gains.

Unfortunately, multi-element antenna arrays can tend toward the complex and expensive. For example, for an aircraft platform, antenna elements may be required on both the top and bottom of the aircraft to enable communications in all desired directions (e.g., to satellites in orbit and to fixed stations on the ground). A large number of individual elements may be required to provide desired coverage directions and aperture size. As antenna arrays increase in size there is attendant increase in cost, power, and size due to power amplifiers, low noise amplifiers, phase shifters, and similar components associated with each individual element. Moreover, switching and feed systems become more complex as the number of elements increases. Accordingly, very large arrays, while desirable from a theoretical radio communications performance standpoint, have generally proven to be of limited feasibility except in specialized applications.

SUMMARY OF THE INVENTION

A mobile distributed antenna array system using a plurality of independently moveable airborne antenna elements has been developed. The mobile distributed antenna array system can provide various advantages over prior art multi-element antenna arrays.

In some embodiments of the invention, a mobile distributed antenna array system can include a plurality of mobile elements. Each mobile element can be capable of controlled movement in three dimensions. The mobile elements can each include an antenna element and radio equipment coupled to the antenna element capable of transmission and/or reception of a propagating radio signal. Movement of the mobile elements can be under control of a control platform. The mobile elements can be positioned relative to each other to achieve a desired array pattern.

In some embodiments of the invention, a method for forming a distributed antenna array can use a plurality of mobile platforms each having radio equipment disposed thereon. The method can include deploying the mobile platforms into a three-dimensional area of interest and controlling the movement of the mobile platforms. Radio signals can be transmitted and/or received from the mobile platforms. The movement of the mobile platforms can be controlled so that a desired antenna pattern is formed relative to the transmitter or received radio signals.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION

Figure 1:
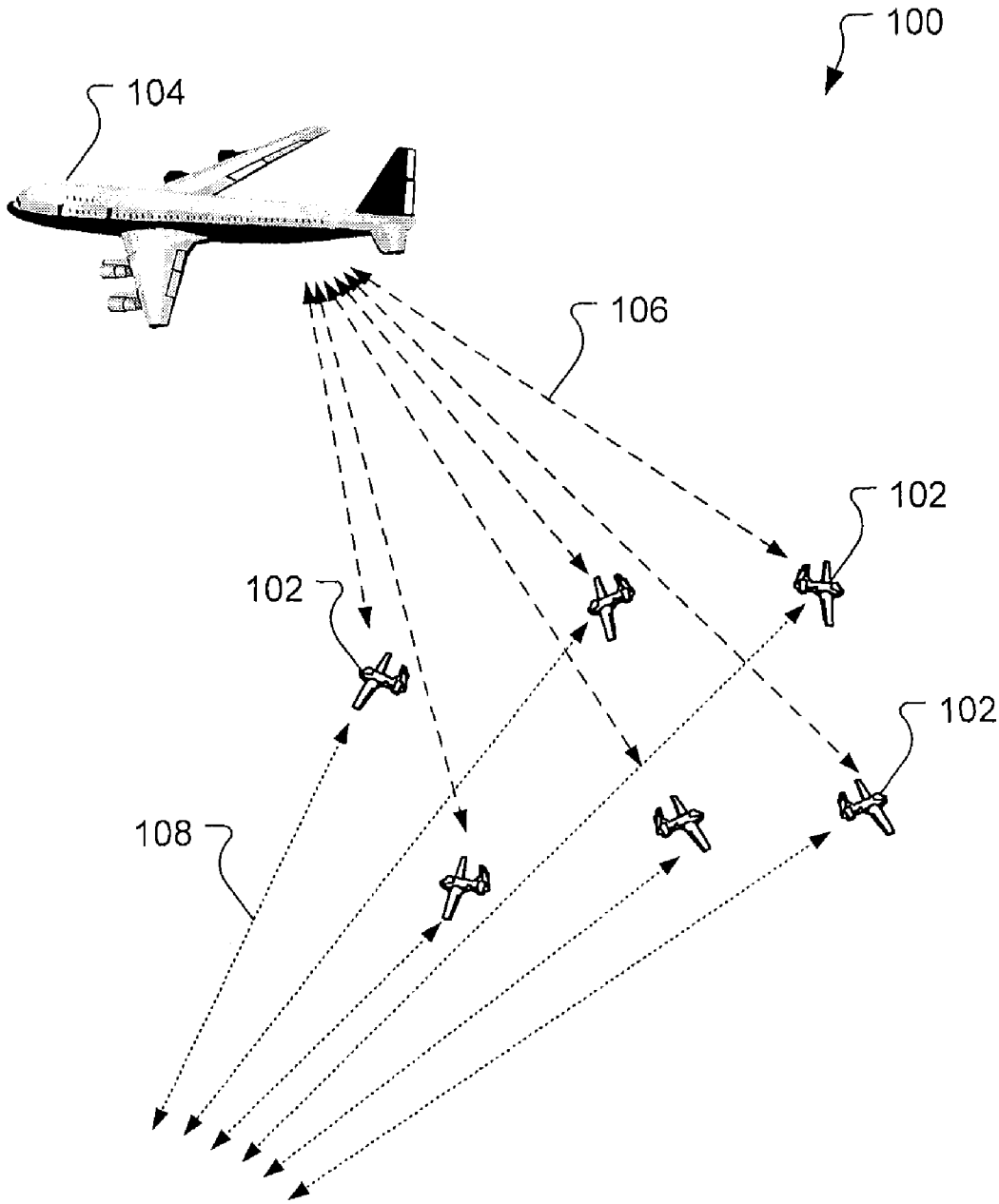
FIG. 1 is pictorial block diagram of a mobile distributed antenna array system in accordance with some embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used:

The singular forms "a," "an," and "the" include plural referents unless the context clearly dictates otherwise. Thus, for example, reference to an antenna includes reference to one or more antennas.

As used herein, the term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art.

By the term "substantially" is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also as including all of the individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

As used herein, a plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As discussed briefly above, a distributed antenna array can be formed by placing a plurality of antenna elements onto a corresponding plurality of mobile platforms. Antenna elements can take on many forms, including for example horns, dipoles, monopoles, dishes, and other configurations. Various types of mobile platforms can be used, including for example aircraft, lighter than air vehicles, satellites, ships, ground vehicles, and the like. The mobile platforms can be controlled individually, allowing the positioning of the platforms to be optimized for particular functions to be performed by the antenna array. The positioning can be relative to each other, relative to some common reference point, or relative to a coordinate system (e.g., geographic coordinates, military grid locators, arbitrary inertial reference frames, etc.). The mobile platforms can be moveable in three-dimensions.

FIG. 1 illustrates a pictorial block diagram of a mobile distributed antenna array system in accordance with some embodiments of the present invention. The system 100 can include a plurality of airborne mobile platforms 102 capable of controlled movement in three dimensions. For example, the airborne mobile platforms can be unmanned aerial vehicles, as described further below. Each airborne mobile platform can include an antenna element and radio transmission equipment coupled to the antenna elements, as described further below. The radio equipment can be capable of any of transmission, reception, or both transmission and reception of propagating radio signals 108 via the antenna element. A control platform 104 can be capable of communication via links 106 with each of the plurality of airborne mobile platforms to control movement of the platforms. Accordingly, the antenna array can be dynamic, as the positions of the airborne mobile platforms, and therefore antenna elements, can be adjusted during operation. For example, the airborne mobile platforms can be positioned relative to each other to achieve a desired antenna pattern relative to the propagating radio signal, as described further below. While the control platform is shown here as being an airborne vehicle, the control platform can be a ground vehicle, a surface ship, a satellite, or other type of platform. Similarly, while airborne mobile platforms are shown, surface ships, underwater vehicles, ground vehicles, and spacecraft platforms can also be used in embodiments of the present invention.

Figure 2:
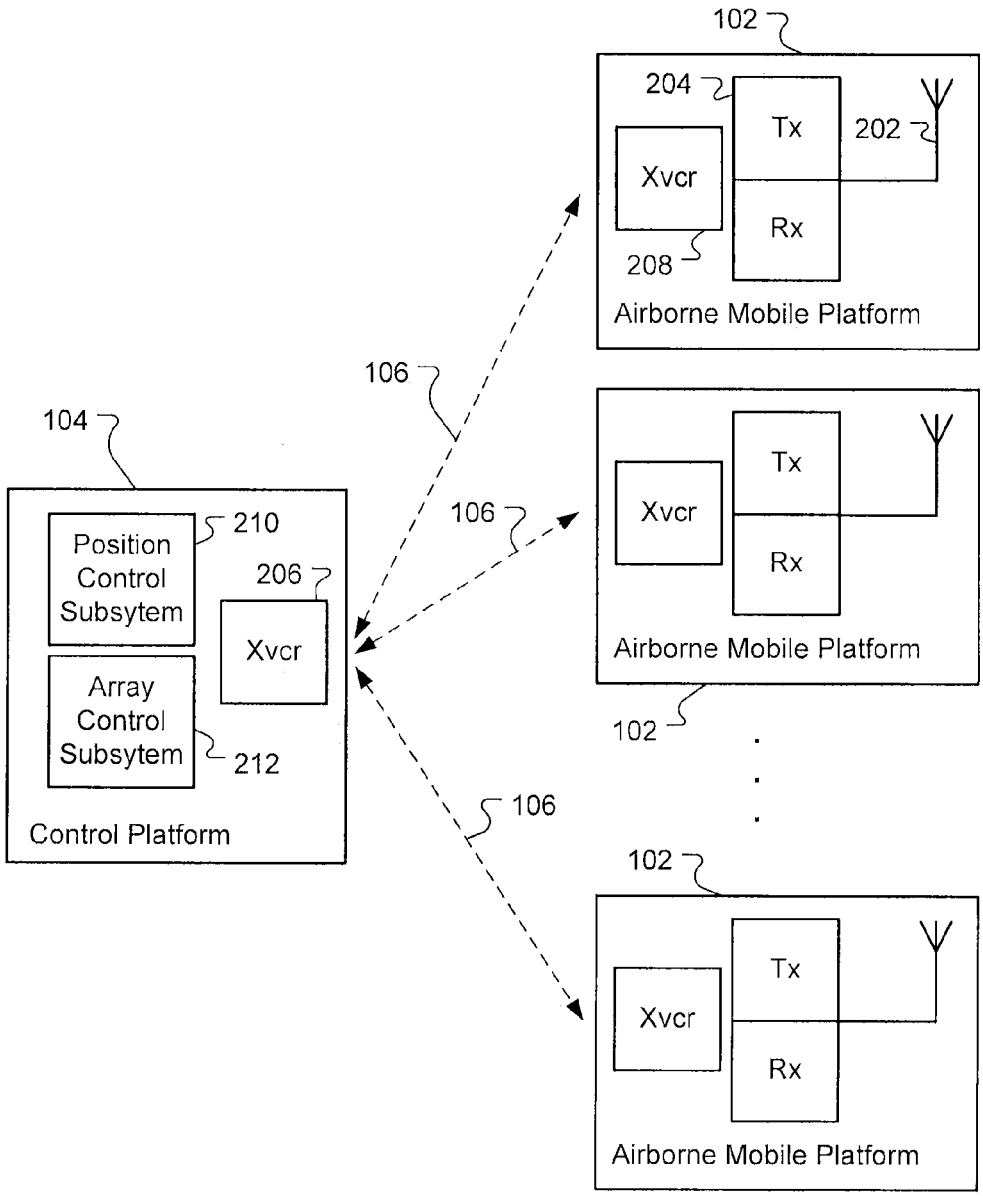
FIG. 2 is a functional block diagram of one implementation of the system of FIG. 1 in accordance with some embodiments of the present invention

FIG. 2 illustrates a functional block diagram of one detailed implementation of the system of FIG. 1 in accordance with some embodiments of the invention. Each of the airborne mobile platforms 102 can include an antenna element 202 and radio equipment 204. The radio equipment can be, for example a transmitter, a receiver, or a transceiver. The links 106 between the control platform 104 and the airborne mobile platforms can be provided by wireless transceivers 206, 208 capable of communication over a wireless radio channel. Operation of some exemplary wireless transceivers is explained in further detail below.

In some embodiments, the control platform 104 can include a position control subsystem 210 and an array control subsystem 212. The position control subsystem can communicate with each of the airborne mobile platforms to control their movement, for example, by transmitting control commands from the control subsystem to the airborne mobile platforms. The array control subsystem can communicate with each of the airborne mobile platforms to control the transmission and/or reception of propagating radio signals via the antenna elements 202. For example, the control platform can communicate a signal to each of the airborne mobile platforms, which can be retransmitted by the antenna elements. As another example, the airborne mobile platforms can each receive a signal via their antenna elements and communicate the received signals to the control platform. In some embodiments, the position control and array control functions can be combined in the control platform.

The position control subsystem 210 and the array control subsystem 212 can share the communicate links 106, for example, by multiplexing information into a common radio channel. Alternately, separate links can be provided where position control can be performed over a first communication link and array control can be performed over a second communication link. The first and second communications links can be, for example, frequency division multiplexed radio channels, time division multiplexed radio channels, code division multiplexed radio channels, other types of radio channels, and combinations thereof. The communications links can use a different channel for communications between the control platform and each airborne mobile platform. The channels can be, for example, frequency division multiplexed radio channels, time division multiplexed radio channels, code division multiplexed radio channels, other types of radio channels, and combinations thereof.

Turning to the details of controlling the antenna array pattern, a number of different scenarios can be used in embodiments of the present invention. Returning to FIG. 1, the airborne mobile platforms 102 can be used to transmit, receive, or both. For example, during transmission, a signal source (e.g. a transmitter disposed on the control platform 104) can communicate signals to each of the airborne mobile platforms, and the airborne mobile platforms can retransmit the signal using a controlled phase and amplitude. The combination of the controlled phase and amplitude, along with the positions of the airborne mobile platforms, affects the resulting array pattern for the propagating radio signal 108. During reception, the plurality of airborne mobile platforms can receive a propagating radio signal and the resulting received signals be combined in a signal combiner (e.g. a signal combiner disposed on the control platform) to form a composite signal. The amplitudes and phases of the received signals can be controlled by the control platform (e.g., varied on the airborne mobile platforms or varied at the control platform) so that, in combination with the positions of the airborne mobile platforms, a desired array pattern for the propagating radio signal is obtained. The airborne mobile platforms can be used for simultaneous transmission and reception, transmission only, reception only, or switching between transmission and reception.

In general, the process of combining signals in an antenna array is referred to as beamforming. While beamforming has been used in some adaptive antenna array systems, generally prior antenna array systems have used a fixed relative placement of the antenna elements. For example, airborne phased array antennas typically comprise a large number of individual elements mounted in close proximity to each other on a surface of the airborne platform. Typically, the elements are mounted less than a half wavelength apart to avoid so-called grating lobes. Grating lobes can represent unwanted peaks or nulls in the response which result when a set of regularly spaced elements are positioned more than about a half wavelength apart.

In contrast, a mobile distributed antenna array can be sparse (using antenna elements many wavelengths apart) yet avoid undesirable grating lobes or sidelobes by positioning the airborne mobile platforms appropriately. In particular, the airborne mobile platforms can be positioned in three-dimensional space so that, in combination with electronic steering (e.g., through phase and amplitude control), a desired response without grating lobes is produced. For example, the airborne mobile platforms can be positioned using irregular spacing to help avoid grating lobes. Because the positions of the airborne mobile platforms can be controlled, additional degrees of freedom are obtained in forming the antenna pattern as compared to a fixed element array. These additional degrees of freedom can accordingly translate into improved performance and greater flexibility.

Adaptation of the array can be performed in several manners. One approach is to directly compute desired positions, phasing, and amplitude for the airborne mobile platforms to achieve a desired antenna pattern. The desired antenna pattern can vary with time, and thus repeated or iterative calculations can be performed to provide updates to the desired positions, phasings and amplitudes used by the individual mobile platforms. Another approach is to adaptively form the desired beam pattern, for example, to optimize signal level, signal to noise ratio, signal to interference ratio, or other similar parameter at a receiver (e.g., when receiving at a network node or when receiving at the control platform). Accordingly, control of the array can include providing feedback from signal processing circuitry into the position control of the airborne mobile platforms.

One advantage of the mobile distributed antenna array can be scalability. For example, the number of airborne mobile platforms (and hence the number of antenna elements) used can be varied as needed. For example, a small number of airborne mobile platforms can be deployed when only a small number of antenna elements is needed, helping to save or conserve resources.

Adaptation of the mobile distributed antenna array can also be performed, for example using measurements of signal to noise ratio, signal to interference ratio, and similar measurements while varying weighting (phases and gains) of signals transmitted via the individual antenna elements. As another example, control of antenna patterns can be determined adaptively, based on open-loop, closed-loop, or other techniques.

Relative positioning of the airborne mobile platforms can be determined using a variety of techniques. In one example, the airborne mobile platforms can include Global Positioning System (GPS) receivers (or the like) which allow their position to be determined. As another example, the airborne mobile platforms can determine their relative positions by ranging between each other and/or the control platform. While in some applications (e.g. open loop transmit beamforming) accurate position control can be desirable, in other applications (e.g. closed loop receive beamforming) accurate position control can be omitted.

Figure 3:
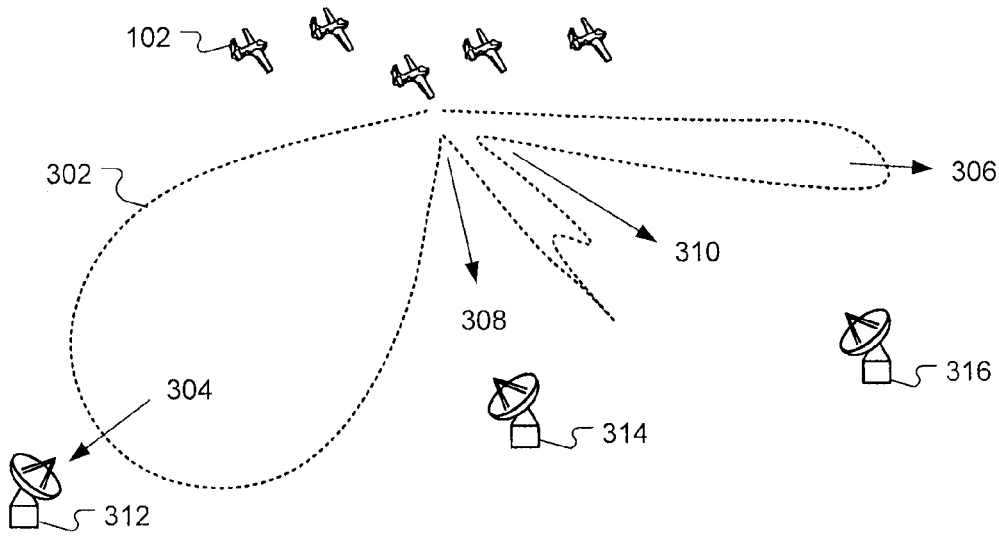
FIG. 3 is an illustration of a distributed array system used for beamforming in accordance with some embodiments of the present invention.

Mobile distributed antenna arrays can be used in a number of different applications in accordance with various embodiments of the present invention. FIG. 3 illustrates an application wherein airborne mobile platforms 102 having antenna elements (referred to in the following discussion for the sake of brevity simply as mobile elements) are positioned so that transmitted (or received) propagating radio signals are coherently combined to form a desired antenna pattern 302. The desired antenna pattern can include peaks 304, 306 in certain directions and nulls 308, 310 in other directions. The number of peaks and/or nulls can vary, depending on the number of mobile elements, relative positioning of the mobile elements, and other factors. For example, peaks can be formed in directions corresponding to a communications node 312 to which communication is desired. Increased antenna gain can be useful to enable signals to be received by a disadvantaged platform (e.g., a communication node with limited antenna gain or receiver performance or a communication node located in an environment with high signal attenuation). Nulls can be directed towards a jammer or eavesdropper 314, 316. Array techniques such as phase-shift or delay-and-sum type beamforming can be applied.

As another example, a mobile distributed antenna array can be used in a jamming application. In a jamming application, noise or interfering signals are transmitted in an attempt to disrupt or inhibit an adversary's communications ability. In a jamming application, peaks of the antenna pattern can be directed towards enemy communications nodes and nulls can be directed toward friendly communications nodes.

Generating desired peaks and nulls (referred to generally as beamforming) can include accurate positioning of the mobile elements 102 relative to each other. For example, positioning can use GPS or self-ranging as described above. Synchronization of timing between the mobile platforms can be provided using similar techniques. As another example, separate control links (for position control, timing synchronization, and similar functions) and communications links (for network communication data related to network nodes) can be provided between the mobile elements and the control platform 104.

Figure 4:
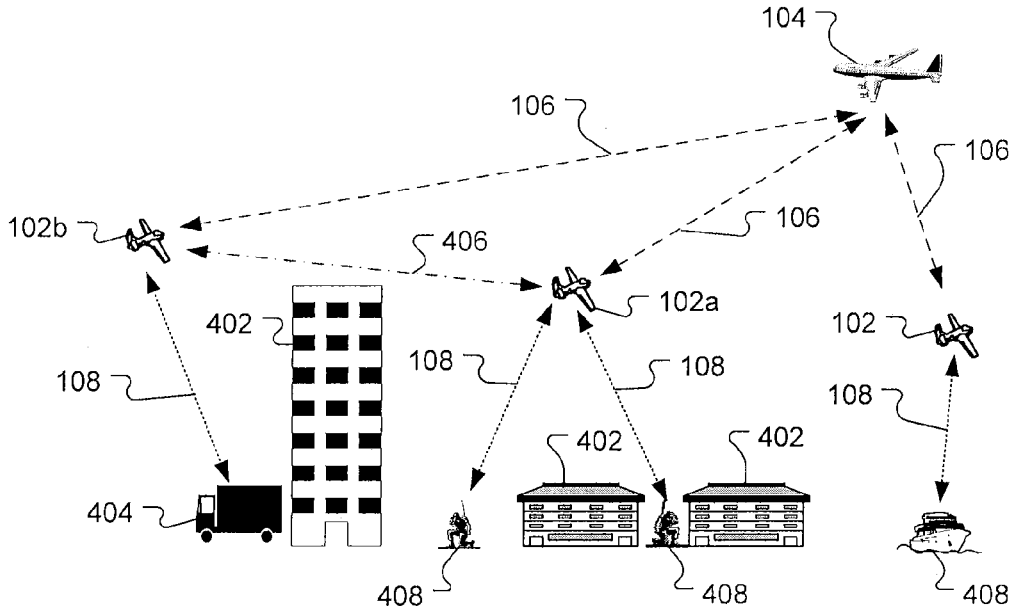
FIG. 4 is an illustration of a distributed array system used for range extension in accordance with some embodiments of the present invention.

FIG. 4 illustrates another application, where the mobile elements 102 are positioned to provide signal coverage over a desired geographic extent so that transmitted (or received) propagating radio signals can be received over a larger area than would be possible if a single antenna element was used. For example, a mobile element can be positioned on the other side of an obstruction 402 (e.g., a building, mountain, etc.) that would block direct line of sight communications between the control platform 104 and a communication node 404.

Inclusion of a large number of geographically dispersed mobile elements can enable communications coverage over a large geographic extent and reaching geographically dispersed nodes 408. Because the coverage areas of the individual mobile elements can be non-overlapping, phase control of transmitted and received radio signals from the individual mobile elements can be omitted if desired.

One benefit of the example in FIG. 4 can be that the transmission power required by the geographically dispersed nodes 408 can be reduced, since shorter range communications to the mobile element 102 can be performed, rather than requiring signals transmitted from the nodes to directly reach the control platform 104. This can be particularly valuable when the nodes are battery operated or similarly limited.

If desired, the mobile elements can also be used to relay signals between each other, for example, to provide even greater range extent. For example, a first one 102*a* of the mobile elements can receive transmitted signals from the control platform 104 and retransmit the signals to a second one 102*b* of the mobile elements to form a relay link 406. Similarly, the second one of the mobile elements can receive signals from a communication node 404 which are retransmitted (relayed) back to the control platform via the first one of the mobile elements.

In a relay configuration, different frequencies (e.g., frequency division multiplexing techniques) can be used for the relay link 406 than for the links 108 to the communications nodes to avoid interference problems. Alternately, time division multiplexing, code division multiplexing techniques, or other multiplexing techniques and combinations can be used. The mobile elements can include directional antennas which can mitigate interference problems, and can allow the same frequencies to be used for relay links and communications links.

Analogously, in a jamming application, the mobile elements 102 can be positioned so that transmitted radio signals create interference over a desired geographic extent. Jamming applications can also incorporate relay functions into the mobile elements as described above.

Figure 5:
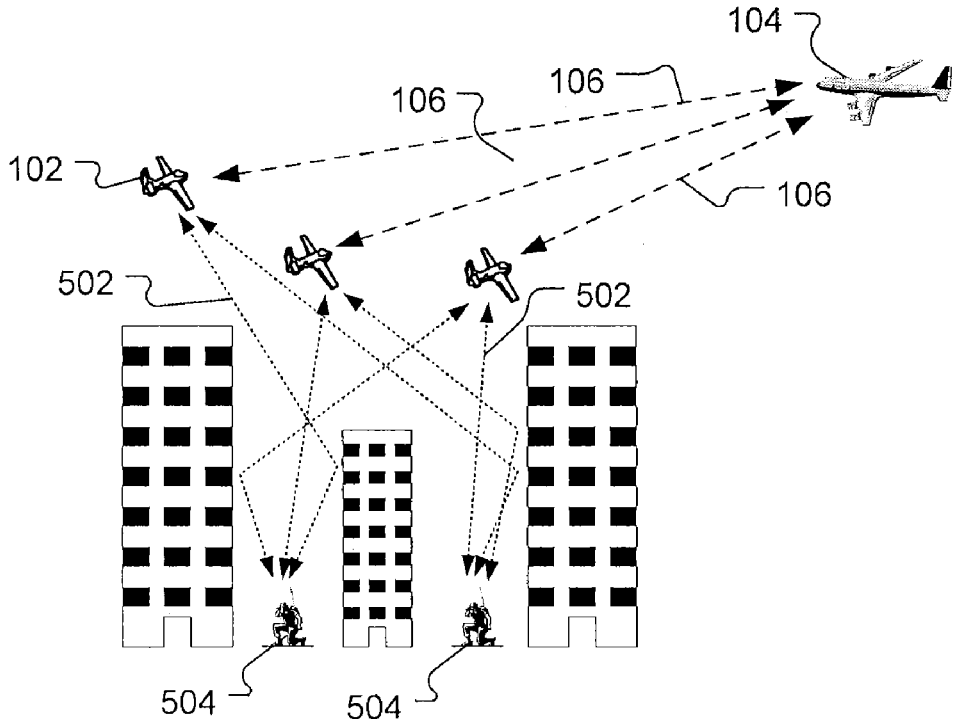
FIG. 5 is an illustration of a distributed array system used for multiple-input multiple-output multipath generation in accordance with some embodiments of the present invention.

FIG. 5 illustrates yet another application, wherein the mobile elements 102 are positioned to provide a plurality of multipath components 502. Multipath components can be beneficial in providing diversity gain, multiple-input multiple-output (MIMO) gain, and similar benefits. For example, using a spread spectrum waveform, multipath components can be resolved for path length differences in excesses of about one chip time. Rake receiver processing can be used to coherently combine multiple components to provide increased performance. As another example, MIMO processing can allow for transmission of differing data streams in parallel using a number of the individual antenna elements. These data streams can be resolved at a receiver to enable data rate increases. While conventionally, MIMO has relied on multipath naturally produced by the radio channel, in contrast the mobile distributed antenna array can be used to artificially introduce multipath components. The introduced multipath components can be used beneficially for transmission from the distributed antenna array to a communication node 504 and for reception from a communication node by the distributed antenna array.

Processing of MIMO signals received from a communication node 504 can be performed entirely on the control platform 104, for example by each mobile element 102 relaying the signals it has received to the control platform. As another example, MIMO signals can be partially processed by each mobile element by including distributed signal processing in the mobile elements as described further below.

Figure 6:
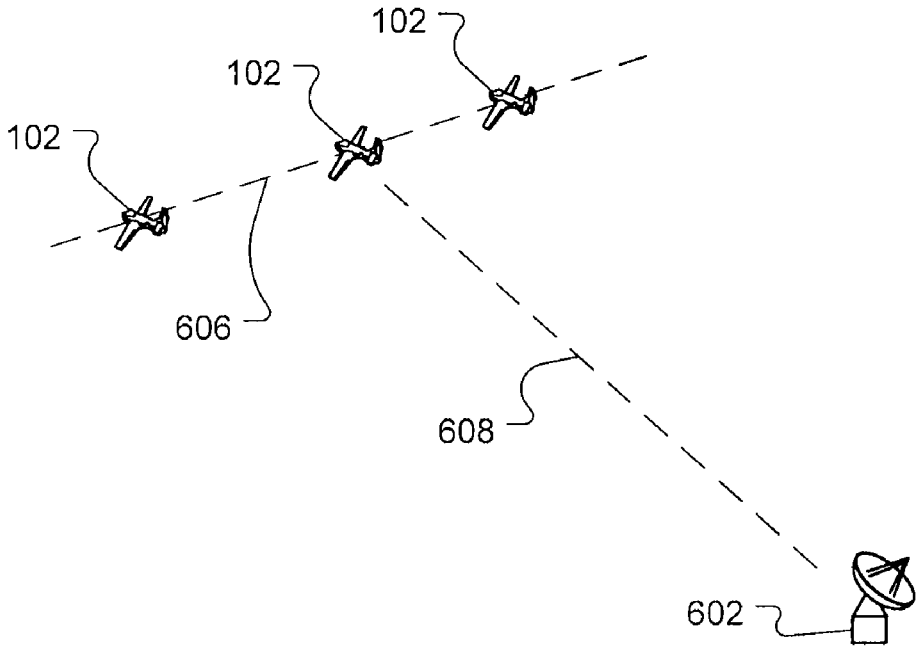
FIG. 6 is an illustration of a distributed array system used for direction finding in accordance with some embodiments of the present invention.

As another example, a distributed antenna array can be used for signal intelligence, monitoring, source localization, and similar applications. FIG. 6 illustrates use of a distributed antenna array for direction finding. In general, direction finding (e.g., triangulation) involves determining a direction to a signal source 602 from two or more mobile elements 102 at differing detection locations, and then determining the location of the signal based on characteristics of the signal (e.g., angle of arrival, time of arrival, time difference of arrival, signal strength, etc.) received at the detection locations. In some techniques, direction finding can be more accurate when the baseline 606 (a line drawn between the two detection locations) is roughly perpendicular to a bearing 608 from the vicinity of the detection locations toward the location of the signal source, and less accurate when the signal source is located close to being along a line that is collinear with the baseline. Accordingly, when the distributed antenna array is used for direction finding, the ability to move the mobile elements relative to each other allows for the direction finding baseline to be varied, potentially improving the resolution and accuracy of the solution. Furthermore, by using more than two mobile elements, multiple baselines can be provided which can enable enhanced accuracy, simultaneous direction finding in multiple directions, or reduced ambiguity in direction finding solutions.

As mentioned above, the mobile elements can be used for transmitting, receiving, or both. For example, in some applications, some mobile elements can be used for transmitting only (e.g., for jamming or communications). Other mobile elements can be used for receiving only (e.g., for interceptions, direction finding or communications). Other mobile elements can be used for both receiving and transmitting. Some mobile elements can switch back and forth between transmitting and receiving at different times and some mobile elements can simultaneously transmit and receive. Mobile elements can be deployed to form a distributed antenna array, and additional mobile elements deployed at a later time to augment the antenna array (e.g., in response to changes in operational requirements or environmental conditions).

Figure 7:
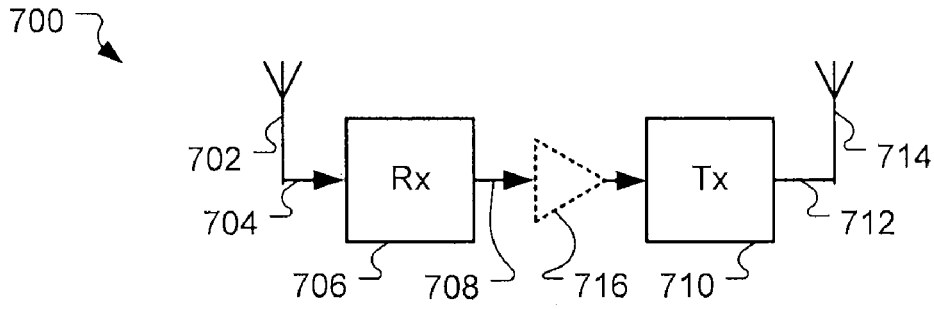
FIG. 7 is a block diagram of a mobile element implementation in accordance with some embodiments of the present invention.

FIGS. 7-11 illustrate block diagrams of several different implementations of mobile elements in accordance with some embodiments of the present invention. FIG. 7 shows a mobile element 700 that can be used for relaying of signals. The mobile element can include a first antenna 702 which receives receive radio signal 704 from a first link. The radio signals can be processed by a receiver 706 to form a relay signal 708, which can then be processed by a transmitter 710 to produce a transmit radio signal 712. The transmit radio signal can be provided to a second antenna 714 for transmission on a second link. The first link can, for example, be from the control platform to the mobile element, and the transmit signal can be relayed to a communication node as part of a coherent antenna array (e.g., FIG. 3), distributed area coverage (e.g., FIG. 4), or similar applications (e.g. FIGS. 5-6). As another example, the first link can be from a communication node to the mobile element, and the relay signal can be passed to the control platform via the second link where the first antenna is used as part of a coherent antenna array, distributed area coverage, or similar applications. As yet another example, the first link can be from the control platform or a communication node, and the second link to another mobile element (e.g., relay link 406 shown in FIG. 4). As yet another example, the first link can be from a mobile element (e.g., relay link 406 shown in FIG. 4) and the second link to the control platform or a communication node.

If desired, a controllable gain amplifier or phase shifter 716 can be included within the mobile element 700. For example, the amplifier/adjuster can be used for shaping antenna patterns in a coherent antenna array application as described above. As another example, the amplifier/shifter can be used to provide a desired signal level for range extension and relay type applications as described above. The amplifier/shifter can be controlled by a control platform, for example, allowing for changes in the gain or phase with time.

Figure 8:
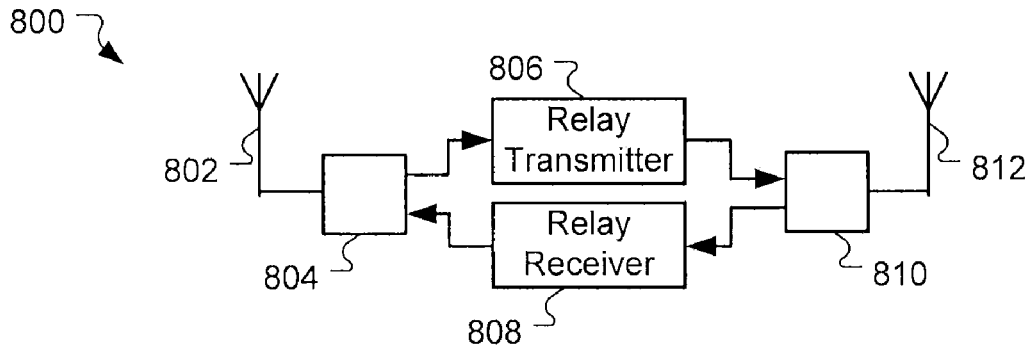
FIG. 8 is a block diagram of another mobile element implementation in accordance with some embodiments of the present invention.

FIG. 8 illustrates another implementation of a mobile element suitable for use in simultaneous transmission and reception. The mobile element 800 can include a first antenna 802 and a second antenna 812. A relay transmitter 806 and a relay receiver 808 can be coupled to the antennas via diplexers 804, 810. The relay transmitter and relay receiver can be as simple as a power amplifier (for example, when the reception and transmission are on the same frequency), a translator or transponder (e.g., for translating from a reception frequency band to a transmission frequency band), a demodulator and modulator for fully demodulating and remodulating relay data), or other combination of radio equipment.

If desired, a single antenna can be shared between the relay transmission and relay reception functions, for example by replacing diplexers 804, 810 with a single four way diplexer coupled to the single antenna, provided that reception and transmission on each of the links all occurs on a different frequency.

Figure 9:
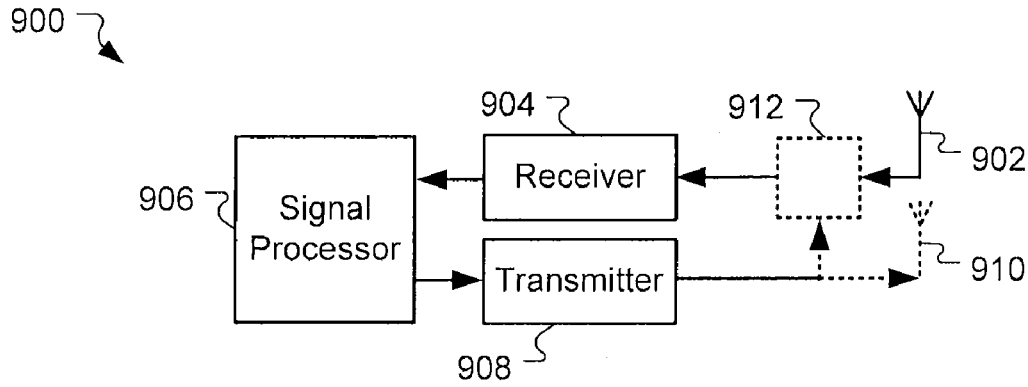
FIG. 9 is a block diagram of a mobile element implementation for use in a distributed signal processing array in accordance with some embodiments of the present invention.

By demodulation and remodulating relay signals, signal processing can be performed on the individual mobile elements to provide distributed signal processing within the distributed antenna array. For example, FIG. 9 illustrates an implementation of a mobile element having a signal processor. Signals can be received from a first antenna 902, processed by a receiver 904, and signal processing performed in the signal processor 906. The output of the signal processor can be transmitted by transmitter 908 via a second antenna 910. FIG. 9 also illustrates that the mobile element can use a single antenna shared between transmission and reception using a switch or diplexer 912. For example, using a diplexer, simultaneous transmission and reception on different frequencies can be performed. Alternately, using a switch, transmission and reception can be performed at different times using the same or different frequencies.

Figure 10:
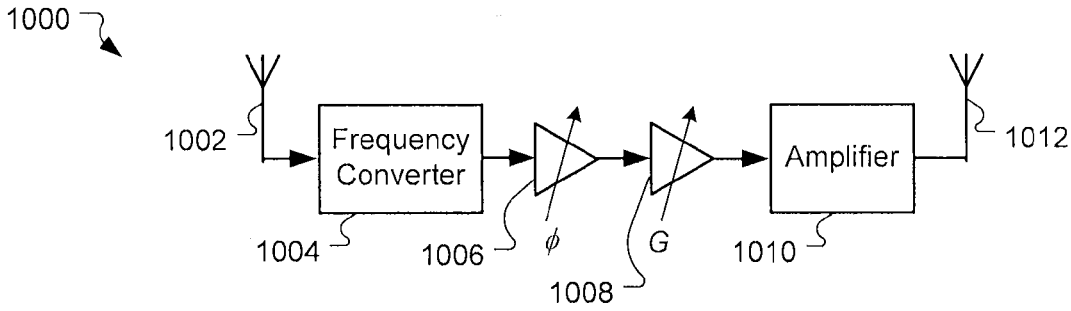
FIG. 10 is a block diagram of another mobile element implementation for use in a beam forming array in accordance with some embodiments of the present invention.

Another example of a mobile element is provided in FIG. 10. The mobile element 1000 can include antennas 1002, 1012, a frequency converter 1004, a phase shifter 1006, a variable gain block 1008, and an output amplifier 1010. Signals received on the first antenna 1002 can be frequency converted from a first frequency to a second frequency, phase shifted, amplified, and retransmitted on the second antenna 1012. The mobile unit can thus be used in transmission from the control unit to network nodes (receiving from the control unit on the first frequency and transmitted to the network nodes on the second frequency). Alternately, the mobile unit can be used in reception from the network nodes (receiving from the network nodes on the first frequency and transmitted to the control unit on the second frequency). As another example, the mobile element can include two of each of the components to allow simultaneous transmission and reception. As for the examples above, a single antenna can replace the two antennas by using a diplexer or antenna switch.

Figure 11:
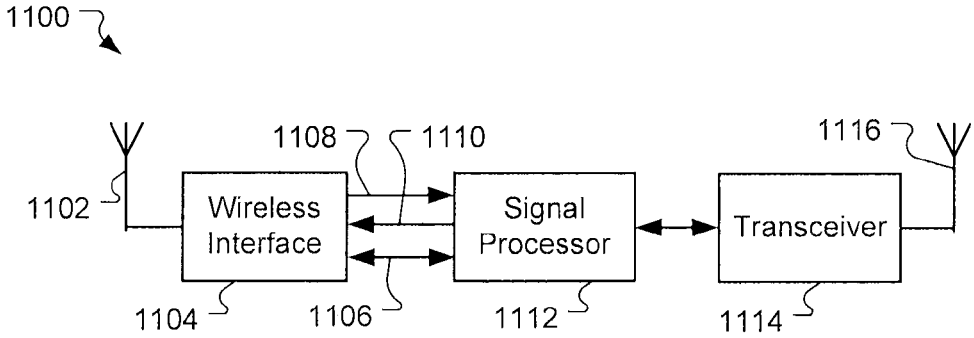
FIG. 11 is a block diagram of another mobile element implementation for use in a distributed signal processing array in accordance with some embodiments of the present invention.

If desired, the mobile units can include signal processing associated with each individual antenna element as illustrated in FIG. 11. For example, the mobile units 1100 can include a signal processor 1112 and a wireless interface 1104 for communications with the control platform via a first antenna 1102. The wireless interface can provide for transmission of commands 1108 to the signal processor from the control platform and for transmission of status 1110 from the signal processor to the control platform. Communications data 1106 can also be relayed to and from the control platform. Communication data can be operated on by the signal processor, for example for beam forming, partial beam forming, distributed MIMO processing, cooperative communications, and other functions as described herein. Communications data can be communicated via a transceiver 1114 to network nodes via a second antenna 1116.

Inclusion of signal processing on the individual mobile units can be used to implement filter-and-sum beamforming as an alternative to phase-shift or delay-and-sum type beamforming as described above. An additional benefit of including signal processing on the individual antenna elements can be enhanced scalability. For example, as additional antenna elements are deployed, the signal processing power available within the array increases. Distributed signal processing architectures can also provide benefits in reducing the amount of data that is transferred between the individual antenna elements and the control platform. Accordingly, the individual antenna elements can be relatively self-contained, providing for distributed adaptation, array beam forming, nulling, and other functions while requiring minimal direction from the control platform. Signal processing can be performed on individual elements, on the control platform, or a combination of both, depending on which is most advantageous in a particular application.

A distributed antenna array system can include any of the different types of mobile elements illustrated above and other types of mobile elements, and can use a combination of different types of mobile elements. Mobile elements need not correspond exactly to one of the configurations shown above, but can include a mixture of different elements as described above.

One benefit of distributed antenna arrays as described above can be that the antenna array can be easily deployed. For example, the mobile elements can be small unmanned aerial vehicles having radio equipment and antennas disposed thereon. The unmanned aerial vehicles can be stored on an aircraft, and launched when needed to deploy the distributed antenna array. When no longer needed, the unmanned aerial vehicles can be retrieved by the aircraft or disposed of. The aircraft can also function as the control platform. One benefit of using unmanned aerial vehicles can be that the exposure of personnel to hostile forces can be reduced.

Figure 12:
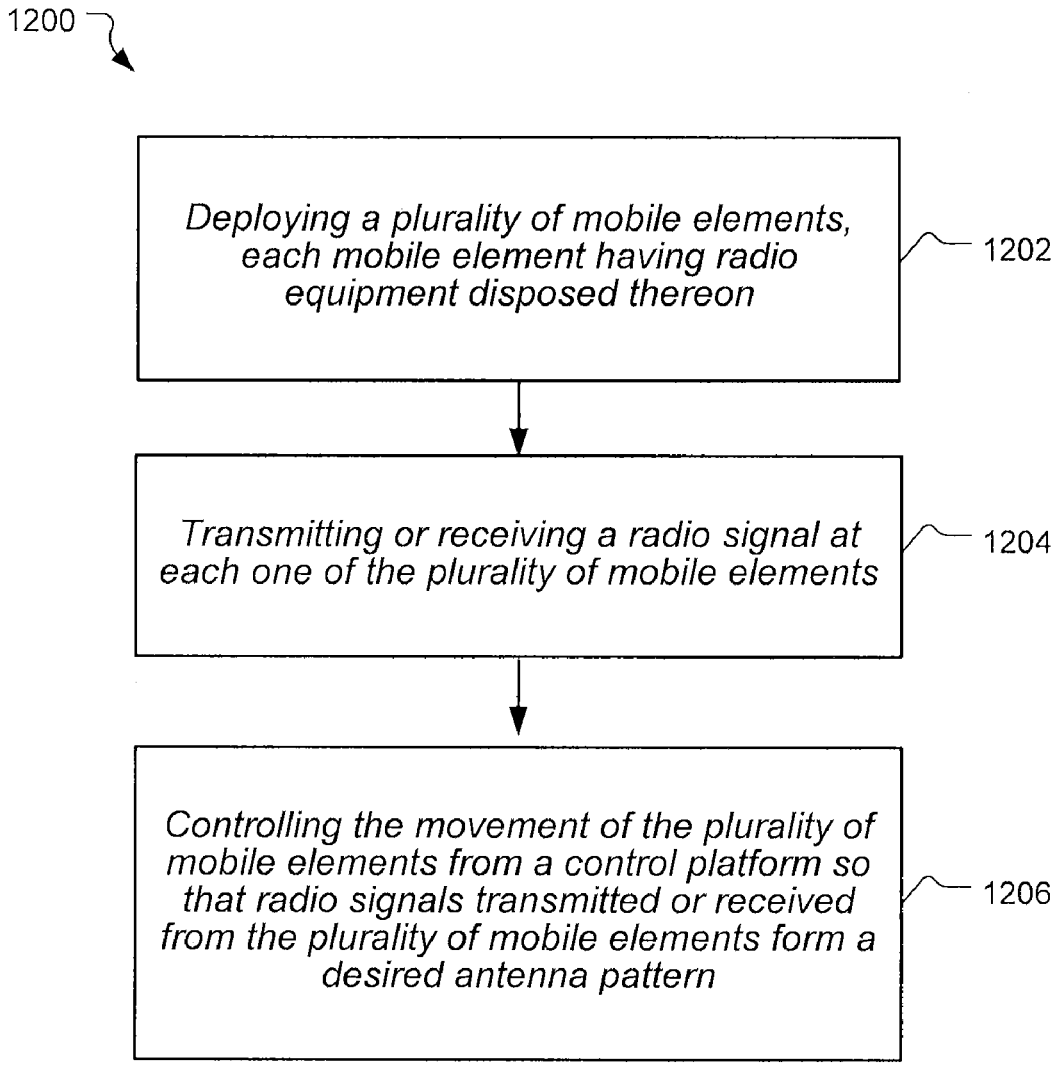
FIG. 12 is a flow chart of a method of forming a distributed antenna array using a plurality of mobile elements in accordance with some embodiments of the present invention.

FIG. 12 illustrates a method of forming a distributed antenna array using a plurality of mobile elements. The method 1200 can include deploying 1202 a plurality of mobile elements. For example, deploying can include launching the mobile elements from an airborne control platform as described above. As another example, the mobile elements can be deployed by launching airborne mobile elements from a ground-based control platform. The mobile elements can be positioned with a three-dimensional space, such as for example, the airspace over a battle theatre or an underwater environment.

The mobile elements can include radio equipment, such as the various examples described above, to provide transmitting or receiving capability. Accordingly, the method 1200 can include 1204 transmitting or receiving a radio signal at ones of the plurality of mobile elements. For example, as described above, individual mobile elements can each be transmitting, receiving, transmitting and receiving, or in a standby mode. The method can also include 1206 controlling the movement of the plurality of mobile elements from a control platform so that radio signals transmitted or received from the plurality of mobile elements form a desired antenna pattern. For example, as described above, the antenna pattern can be coherently formed to produce peaks and nulls in desired directions. As another example, as described above, the mobile elements can be positioned so the antenna pattern provides a desired geographic coverage area. As yet another example, as described above, the mobile elements can be positioned so the antenna pattern provides multipath components for multiple-input multiple-output signal communications. Controlling the positions can thus take into account characteristics of the radio signal transmitted or received from the array. For example, adaptive feedback control can be used to adjust phase, amplitude, and positions as described above. Controlling the position of the mobile elements can be performed over a wireless link, for example, as described above.

Summarizing and reiterating to some extent, a mobile distributed antenna array system has been developed. The mobile distributed antenna array can be used in a wide variety of communications applications, such as coherent beam forming, multiple-input multiple-output, range extension, relay, and similar applications. Because the positions of the mobile elements of the distributed antenna array can be controlled, the mobile elements can be positioned into advantageous configurations. This provides additional flexibility as compared to traditional phased array antenna systems which typically use fixed relative positions of the array elements.

The mobile distributed antenna array can be reconfigured to optimize performance for differing scenarios or to adapt to environmental conditions. For example, wide spacing between mobile elements can be used to improve resolution in beam forming or direction finding applications, while dynamic movement of the mobile elements can be performed to resolve ambiguities or losses created by grating lobes or disadvantageous geometries. Mobile elements can be added or removed from the array during operation to adjust to differing operational requirements or environmental conditions.

Different portions of the antenna array can even been operated in different modes. For example, some mobile elements can be used for range extension and simultaneously other mobile elements can be used for nulling a jammer affecting one geographic region. As another example, some portions of the antenna array can be used for jamming while other portions are used for communications. During operation, mobile elements may be moved or reassigned to different functions, for example to adapt for changing conditions. Accordingly, a wide variety of operational modes can be implemented by the antenna array.

Additionally, the number of deployed mobile elements can be varied during operation of the distributed antenna array. For example, if conditions change such that a larger number of mobile elements are required, additional mobile elements can be deployed. Conversely, mobile elements may be retrieved, reducing the number of mobile elements active in the array. As another example, mobile elements may be placed into a standby mode, where they no longer needed to be actively transmitting or receiving antennas.

Because the distributed antenna array can be highly mobile, a communication system using the distributed antenna array gains significant flexibility. Communication range can be extended by simply deploying a mobile element (or several linked relay mobile elements) in directions in which increased range is desired. Communications reliability can be enhanced in a particular area by deploying multiple mobile elements to provide diversity paths. Jamming and interference can be mitigated (or created) by deploying multiple mobile elements which are phased to produce desired antenna pattern peaks and nulls.

Because the mobile elements positions can be controlled, it is possible to separate mobile elements to help provide multiple uncorrelated paths. This can help to provide for diversity gain, as the uncorrelated paths experience uncorrelated fading. Conversely, for beamforming, mobile elements can be moved closer together to help provide desired coherence in radiated (or received) signals where needed to achieve a desired solution, without requiring a large number of elements to be provided. Squint losses when steering a beam can also be reduced by moving the mobile elements into more favorable positions. The mode of operation of the array can be changed during operation to respond to environmental conditions. For example, when needed, mobile elements can be positioned for diversity gain, and when needed, mobile elements can be repositioned for nulling or beam formation. Elements can be moved and reassigned from one function to another function adaptively.

In conclusion, while a number of illustrative applications have been illustrated, many other applications of the mobile distributed antenna array are likely to prove useful which have not previously been feasible with conventional antenna arrays. Accordingly, the above-referenced arrangements are illustrative of some applications for the principles of the present invention. It will be apparent to those of ordinary skill in the art that numerous modifications can be made without departing from the principles and concepts of the invention as set forth in the claims.

The invention claimed is:

1. A mobile distributed antenna array system for wireless communications comprising:

a plurality of mobile platforms, each mobile platform capable of controlled movement in three dimensions and comprising:

an antenna element, and radio equipment coupled to the antenna element and capable of at least one of transmission and reception of a propagating radio signal via the antenna element; and a control platform capable of communication with each of the plurality of mobile platforms to control of movement of the plurality of mobile platforms and position the mobile platforms relative to each other to achieve a desired array pattern relative to the propagating radio signal.

2. The system of claim 1, wherein the control platform comprises:

a position control system configured to communicate with each one of the plurality of mobile platforms via a first communication link to control movement; and an array control subsystem configured to communicate with each one of the mobile platforms via a second communication link to control at least one of phase and amplitude of the radio signal during the at least one of transmission and reception.

3. The system of claim 1, wherein the radio equipment is configured to transmit radio signals and wherein the system further comprises:

a signal source in communication with each one of the plurality of mobile platforms to communicate a source signal to each one of the plurality of mobile platforms; and wherein the plurality of mobile platforms transmits the source signal using a phase and amplitude under control of the control platform, wherein the combination of the phase, amplitude, and positions of the mobile platforms results in the desired array pattern for the propagating radio signal.

4. The system of claim 1, wherein the radio equipment is configured to receive radio signals and wherein the system further comprises:

a signal combiner in communication with each one of the plurality of mobile platforms to communicate a received signal from each one of the plurality of mobile platforms; and wherein the plurality of mobile platforms receives the propagating radio signal using a phase and amplitude under control of the control platform to form the received signal, wherein the combination of the phase, amplitude, and positions of the mobile platforms results in the desired array pattern for the propagating radio signal.

5. The system of claim 1, wherein the control platform is an aerial vehicle.

6. The system of claim 1, wherein the control platform is a ground vehicle.

7. The system of claim 1, wherein ones of the mobile platforms comprise an aerial vehicle.

8. The system of claim 1, wherein the antenna element of each of the plurality of mobile platforms comprises a receive antenna and a transmit antenna; and the radio equipment of each of the plurality of mobile platforms comprises a power amplifier having an input coupled to the receive antenna and an output coupled to the transmit antenna.

9. The system of claim 1, wherein the radio equipment of each of the plurality of mobile platforms comprises a signal processor.

10. A method of forming a distributed antenna array using a plurality of mobile elements comprising:

deploying a plurality of mobile elements, each mobile element having radio equipment disposed thereon;

transmitting or receiving a radio signal at ones of the plurality of mobile elements; and controlling the movement of the plurality of mobile elements from a control platform so that radio signals transmitted or received from the plurality of mobile elements form a desired antenna pattern.

11. The method of claim 10, wherein the deploying comprises releasing the plurality of mobile elements from the control platform, wherein the mobile elements are disposed on corresponding unmanned aerial vehicles.

12. The method of claim 10, wherein transmitting or receiving a radio signal comprises:

transmitting a first radio signal at a first one of the plurality of mobile elements; and receiving a second radio signal at a second, differing one of the plurality of mobile elements.

13. The method of claim 10, wherein transmitting or receiving a radio signal comprises:

transmitting a first radio signal at each of the plurality of mobile elements; and receiving a second radio signal at each of the plurality of mobile elements.

14. The method of claim 10, wherein controlling the movement comprises moving the plurality of mobile elements in three-dimensions relative to each other.

15. The method of claim 10, wherein controlling the movement comprises moving the plurality of mobile elements in three-dimensions relative to each other based on characteristics of the radio signal.

16. The method of claim 10, wherein controlling the movement comprises positioning the plurality of mobile elements so that transmitted radio signals coherently combine to form a peak in a first direction.

17. The method of claim 10, wherein controlling the movement comprises positioning the plurality of mobile elements so that transmitted radio signals coherently combine to form a null in a first direction.

18. The method of claim 10, wherein controlling the movement comprises positioning the plurality of mobile elements so that transmitted radio signals cover a desired geographic extent.

19. The method of claim 10, wherein controlling the movement comprises positioning the plurality of mobile elements so that transmitted radio signals creates a plurality of resolvable multipath components, and further comprising transmitting data via the transmitted radio signals using multiple-input multiple-output processing techniques.

20. The method of claim 10, wherein transmitting or receiving a radio signal comprises combining received radio signals to form a combined signal.

21. The method of claim 20, wherein controlling the movement comprises positioning the plurality of mobile elements so that the combined signal has an antenna pattern peak in a first direction.

22. The method of claim 20, wherein controlling the movement comprises positioning the plurality of mobile elements so that the combined signal has an antenna pattern a null in a first direction.

23. The method of claim 20, wherein controlling the movement comprises positioning the plurality of mobile elements so that the combined signal contains a plurality of resolvable multipath components, and further comprising receiving data via the received radio signals using multiple-input multiple-output processing techniques.

24. The method of claim 10, wherein controlling the movement of the plurality of mobile elements comprises positioning the plurality of mobile elements to form a baseline for direction finding in a desired direction.

25. The method of claim 10, wherein controlling the movement of the plurality of mobile elements comprises positioning the plurality of mobile elements so that received radio signals cover a desired geographic extent.

26. The method of claim 10, wherein transmitting or receiving a radio signal comprises:

receiving a radio signal at a first one of the plurality of mobile elements;

transmitting a retransmitted radio signal from the first one of the plurality of mobile elements; and receiving the retransmitted radio signal at a second one of the plurality of mobile elements.

27. The method of claim 10, wherein controlling the movement of the plurality of mobile elements comprises communicating control commands from the control platform to the plurality of mobile elements via a wireless link.

28. The method of claim 10, wherein transmitting or receiving a radio signal at ones of the plurality of mobile elements comprises communicating signals between the control platform and each of the plurality of mobile elements via a wireless link.

29. The method of claim 28, wherein the communicating signals between the control platform and each of the plurality of mobile elements comprises using a different channel for each mobile element, wherein the channel is any of a frequency division multiple access channel, a time division multiple access channel, a code division multiple access channel, and combinations thereof.

30. The method of claim 10, further comprising varying a number of the plurality of mobile elements that have been deployed.

31. A mobile distributed antenna array system for wireless communications comprising:

means for deploying a plurality of mobile elements into a three-dimensional space;

means for transmitting or receiving a radio signal disposed on each one of the plurality of mobile elements; and means for controlling the movement of the plurality of mobile elements within the three-dimensional space so that the radio signals transmitted or received from the plurality of mobile elements form a desired antenna pattern.

32. The system of claim 31, further comprising means for coordinating at least one of amplitude and phase of the radio signal at each one of the plurality of mobile elements.

33. The system of claim 31, wherein ones of the plurality of mobile elements comprises an unmanned aerial vehicle.

34. The system of claim 31, further comprising a control platform, wherein the means for controlling is at least partially disposed on the control platform.

35. The system of claim 34, wherein the control platform comprises an aerial vehicle.

36. The system of claim 34, wherein the means for deploying a plurality of mobile elements further comprises means for varying a deployed number of mobile elements.

37. The system of claim 1, wherein the control platform can position the mobile platforms relative to each other so that the propagating radio signal coherently combines across the antenna elements to form the desired antenna pattern.

38. The method of claim 10, wherein the transmitting or receiving a radio signal comprises causing the radio signal(s) to coherently combine to form the desired antenna pattern.

39. The system of claim 31, wherein the means for controlling comprising means for controlling the movement of the plurality of mobile of elements so that the radio signals transmitted or received from the plurality of mobile elements coherently combine to form the desired antenna pattern.

* * * * *